US009023196B2

(12) United States Patent
Cooper et al.

(10) Patent No.: US 9,023,196 B2
(45) Date of Patent: May 5, 2015

(54) PROCESS, METHOD, AND SYSTEM FOR REMOVING HEAVY METALS FROM FLUIDS

(71) Applicants: Russell Evan Cooper, Martinez, CA (US); Dennis John O'Rear, Petaluma, CA (US); Sujin Yean, Houston, TX (US); Seyi Abiodun Odueyungbo, Hercules, CA (US)

(72) Inventors: Russell Evan Cooper, Martinez, CA (US); Dennis John O'Rear, Petaluma, CA (US); Sujin Yean, Houston, TX (US); Seyi Abiodun Odueyungbo, Hercules, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 261 days.

(21) Appl. No.: 13/826,213

(22) Filed: Mar. 14, 2013

(65) Prior Publication Data

US 2014/0262955 A1 Sep. 18, 2014

(51) Int. Cl.

| | |
|---|---|
| ***C10G 53/04*** | (2006.01) |
| ***C10G 29/02*** | (2006.01) |
| ***C10G 27/12*** | (2006.01) |

(52) U.S. Cl.

CPC ..... *C10G 29/02* (2013.01); *C10G 27/12* (2013.01)

(58) Field of Classification Search

CPC ..... C10G 27/12; C10G 29/02; C10G 53/02; C10G 53/08; C10G 53/15; C10G 31/09

See application file for complete search history.

(56) References Cited

U.S. PATENT DOCUMENTS

| | | | |
|---|---|---|---|
| 3,873,581 | A | 3/1975 | Fitzpatrick et al. |
| 4,028,236 | A | 6/1977 | Townsend et al. |
| 4,094,098 | A | 6/1978 | Gourley |
| 4,094,777 | A | 6/1978 | Sugier et al. |
| 4,108,769 | A | 8/1978 | Krieg et al. |
| 4,133,755 | A | 1/1979 | Tarao et al. |
| 4,151,077 | A | 4/1979 | Nogueira et al. |
| 4,167,481 | A | 9/1979 | Cremers et al. |
| 4,230,486 | A | 10/1980 | Capuano et al. |
| 4,336,237 | A | 6/1982 | Kudryk et al. |
| 4,338,288 | A | 7/1982 | Rollmann |

(Continued)

FOREIGN PATENT DOCUMENTS

WO WO2011/131850 * 10/2011 ..... C10G 31/09

OTHER PUBLICATIONS

Pending U.S. Appl. No. 12/109,194, filed Apr. 24, 2008.

(Continued)

*Primary Examiner* — Walter D Griffin
*Assistant Examiner* — Derek Mueller

(57) ABSTRACT

Trace element levels of mercury in crude oil are reduced by first passing the crude oil through a filtration device to generate filtered crude having a reduced concentration of mercury and a reject stream having a concentrated mercury level. In one embodiment, the filtration device is back-flushed to generate the reject stream. In another embodiment, the reject stream comprises a portion of the retentate from a cross-flow filter device. The reject stream is treated with an extractive agent selected from tetrakis(hydroxymethyl)phosphonium sulfate; tetrakis(hydroxymethyl) phosphonium chloride; an oxidizing agent; an organic or inorganic sulfidic compound to extract a portion of the mercury into a water phase for subsequent removal. In one embodiment, the extractive agent is a reductant to convert non-volatile mercury into volatile mercury.

32 Claims, 1 Drawing Sheet

(56) References Cited

U.S. PATENT DOCUMENTS

| | | | |
|---|---|---|---|
| 4,354,942 | A | 10/1982 | Kaczur et al. |
| 4,551,237 | A | 11/1985 | Fenton |
| 4,578,195 | A | 3/1986 | Moore et al. |
| 4,619,744 | A | 10/1986 | Horton |
| 4,678,584 | A | 7/1987 | Elfline |
| 4,708,853 | A | 11/1987 | Matviya et al. |
| 4,709,118 | A | 11/1987 | Yan |
| 4,752,397 | A | 6/1988 | Sood |
| 4,876,025 | A | 10/1989 | Roydhouse |
| 4,877,515 | A | 10/1989 | Audeh |
| 4,880,527 | A | 11/1989 | Audeh |
| 4,902,662 | A | 2/1990 | Toulhoat et al. |
| 4,915,818 | A | 4/1990 | Yan |
| 4,981,577 | A | 1/1991 | Audeh et al. |
| 4,985,389 | A | 1/1991 | Audeh |
| 5,034,203 | A | 7/1991 | Audeh et al. |
| 5,037,552 | A | 8/1991 | Furuta et al. |
| 5,107,060 | A | 4/1992 | Yan |
| 5,110,480 | A | 5/1992 | Yan |
| 5,173,286 | A | 12/1992 | Audeh |
| 5,202,301 | A | 4/1993 | McNamara |
| 5,238,488 | A | 8/1993 | Wilhelm |
| 5,304,693 | A | 4/1994 | Boitiaux et al. |
| 5,336,835 | A | 8/1994 | McNamara |
| 5,360,632 | A | 11/1994 | Johnson et al. |
| 5,601,701 | A | 2/1997 | Cameron et al. |
| 5,961,821 | A | 10/1999 | Varadaraj et al. |
| 6,268,543 | B1 | 7/2001 | Sakai et al. |
| 6,350,372 | B1 | 2/2002 | Degnan et al. |
| 6,403,044 | B1 | 6/2002 | Litz et al. |
| 6,475,451 | B1 | 11/2002 | Leppin et al. |
| 6,521,131 | B1 | 2/2003 | Hamilton et al. |
| 6,685,824 | B2 | 2/2004 | Frankiewicz et al. |
| 6,866,048 | B2 | 3/2005 | Mattox |
| 6,906,398 | B2 | 6/2005 | Yeo et al. |
| 6,960,291 | B2 | 11/2005 | Greaney et al. |
| 7,037,474 | B2 | 5/2006 | Nolan et al. |
| 7,591,944 | B2 | 9/2009 | Carnell et al. |
| 7,666,318 | B1 | 2/2010 | Lehtinen et al. |
| 7,744,763 | B2 | 6/2010 | Cross et al. |
| 2003/0116475 | A1 | 6/2003 | Frankiewicz et al. |
| 2005/0263739 | A1 | 12/2005 | Mattox et al. |
| 2006/0048646 | A1 | 3/2006 | Olson et al. |
| 2008/0000809 | A1 | 1/2008 | Wang et al. |
| 2008/0283470 | A1 | 11/2008 | Gustafsson et al. |
| 2009/0114247 | A1 | 5/2009 | Brown et al. |
| 2009/0304563 | A1 | 12/2009 | Harada et al. |
| 2010/0000910 | A1 | 1/2010 | Gallup et al. |
| 2010/0025184 | A1 | 2/2010 | Shibuya et al. |
| 2010/0032344 | A1 | 2/2010 | Cross et al. |
| 2010/0032345 | A1 | 2/2010 | Cross et al. |
| 2010/0078358 | A1 | 4/2010 | Tullos et al. |
| 2010/0099596 | A1 | 4/2010 | Trahan |
| 2010/0126909 | A1 | 5/2010 | Bhasin et al. |
| 2010/0155330 | A1 | 6/2010 | Burba et al. |
| 2010/0200477 | A1 | 8/2010 | Varadi et al. |
| 2010/0320124 | A1 | 12/2010 | Zhang et al. |
| 2011/0163008 | A1 | 7/2011 | Zhang et al. |
| 2012/0067785 | A1 | 3/2012 | Gallup |

OTHER PUBLICATIONS

Pending U.S. Appl. No. 12/132,475, filed Jun. 3, 2008.
Pending U.S. Appl. No. 12/167,466, filed Jul. 3, 2008.
Pending U.S. Appl. No. 12/883,578, filed Sep. 16, 2010.
Pending U.S. Appl. No. 12/883,921, filed Sep. 16, 2010.
Pending U.S. Appl. No. 12/883,971, filed Sep. 16, 2010.
Pending U.S. Appl. No. 12/883,995, filed Sep. 16, 2010.
Pending U.S. Appl. No. 12/950,060, filed Nov. 19, 2010.
Pending U.S. Appl. No. 12/950,170, filed Nov. 19, 2010.
Pending U.S. Appl. No. 12/950,637, filed Nov. 19, 2010.
Pending U.S. Appl. No. 13/297,436, filed Nov. 16, 2011.
Pending U.S. Appl. No. 13/804,172, filed Mar. 14, 2013.
Pending U.S. Appl. No. 13/804,430, filed Mar. 14, 2013.
Pending U.S. Appl. No. 13/804,662, filed Mar. 14, 2013.
Pending U.S. Appl. No. 13/895,612, filed May 16, 2013.
Pending U.S. Appl. No. 13/895,754, filed May 16, 2013.
Pending U.S. Appl. No. 13/895,850, filed May 16, 2013.
Pending U.S. Appl. No. 13/895,983, filed May 16, 2013.
Pending U.S. Appl. No. 13/896,242, filed May 16, 2013.
Pending U.S. Appl. No. 13/896,255, filed May 16, 2013.
Ashworth, S. C., "Mercury Removal at Idaho National Engineering and Environmentally Laboratory's New Waste Calciner Facility," *Waste Management*, Feb. 27-Mar. 2, 2000, INEEL, Bechtel BWXT Idaho, LLC, Tucson, AZ, pp. 1-20.
Campanella et al., "Mercury Removal from Petrochemical Wastes," *Water Research*, 1986, vol. 20, No. 1, pp. 63-65.
Carrell et al., "Mercury Matters," *Hydrocarbon Engineering*, Dec. 2005, 3 pages.
Chaiyasit et al., "Decontamination of Mercury Contaminated Steel (API 5L-X52) Using Iodine and Iodide Lixiviant," *Modern Applied Science*, Jan. 2010, vol. 4, No. 1, pp. 12-20.
Clever et al., "The Solubility of Mercury and Some Sparingly Soluble Mercury Salts in Water and Aqueous Electrolyte Solutions," *Journal of Physical and Chemical Reference Data*, 1895, vol. 14, No. 3, pp. 631-680.
Corvini et al., "Mercury Removal from Natural Gas and Liquid Streams," *UOP LLC*, 2002, Houston, TX, pp. 1-9.
Findlay et al., "Removal of Elemental Mercury from Wastewaters Using Polysulfides," *Environmental Science and Technology*, Nov. 1981, vol. 15, No. 11, pp. 1388-1390.
Gildert et al., "Mercury Removal from Liquid Hydrocarbons in Ethylene Plants," *AIChE Paper No. 135c*, Mar. 24, 2010, Spring National Meeting, San Antonio, TX, 14 pages.
Kim et al., "Demulsification of Water-In-Crude Oil Emulsions by a Continuous Electrostatic Dehydrator," *Separation Science and Technology*, 2002, vol. 37, No. 6, pp. 1307-1320.
Larson et al., "Mass-Transfer Model of Mercury Removal from Water via Microemulsion Liquid Membranes," *Industrial & Engineering Chemistry Research*, 1994, vol. 33, No. 6, pp. 1612-1619.
Lemos et al., "Demusification of Water-in-Crude Oil Emulsions Using Ionic Liquids and Microwave Irradiation," *Energy Fuels*, 2010, vol. 24, pp. 4439-4444.
Morel et al., "The Chemical Cycle and Bioaccumulation of Mercury," *Annual Review Ecology, Evolution, and Systematics*, 1998, vol. 29, pp. 543-566.
Núñez et al., "Leaching of Cinnabar with HCI-Thiourea Solutions as the Basis of a Process for Mercury Obtention," *Metallurgical Transactions B*, Sep. 1996, vol. 17B, pp. 443-448.
Sharma et al., "Chemical Demulsification ofNatural Petroleum Emulsions of Assam (India)," *Colloid & Polymer Science*, 1982, vol. 260, pp. 616-622.
Sizeneva et al., "Applied Electrochemistry and Corrosion Protection of Metals: Mercury Passivation Solutions of Potassium Chloride and Sodium Hydroxide and Hypochlorite," *Russian Journal of Applied Chemistry*, 2009, vol. 82, No. 1, pp. 52-56.
Sizeneva et al., "Inorganic Synthesis and Industrial Inorganic Chemistry: A Study of Mercury Dissolution in Aqueous Solutions of Sodium Hypochlorite," *Russian Journal of Applied Chemistry*, 2005, vol. 78, No. 4, pp. 546-548.
Venkatesan et al., "Removal of Complexed Mercury by Dithiocarbamate Grafted on Mesoporous Silica," *Journal of Radioanalytical and Nuclear Chemistry*, 2003, vol. 256, No. 2, pp. 213-218.
Waldo, John H., "Some New Water-Soluble Organo-Mercury Compounds," *Water Soluble Organo Compounds*, Mar. 6, 1931, vol. 53, pp. 992-996.
Wasay et al., "Remediation of a Soil Polluted by Mercury with Acidic Potassium Iodide," *Journal of Hazardous Materials*, 1995, vol. 44, pp. 93-102.
Yuan et al., "Fractions and Leaching Characteristics of Mercury in Coal," *Environmental Monitoring and Assessment*, Jan. 6, 2009, vol. 167, pp. 581-586.
Zhao et al., "Removal of Elemental Mercury by Sodium Chlorite Solution," *Chemical Engineering & Technology*, 2008, vol. 31, No. 3, pp. 350-354.
International Search Report and Written Opinion for PCT/US2014/020298, 14 pages.

* cited by examiner

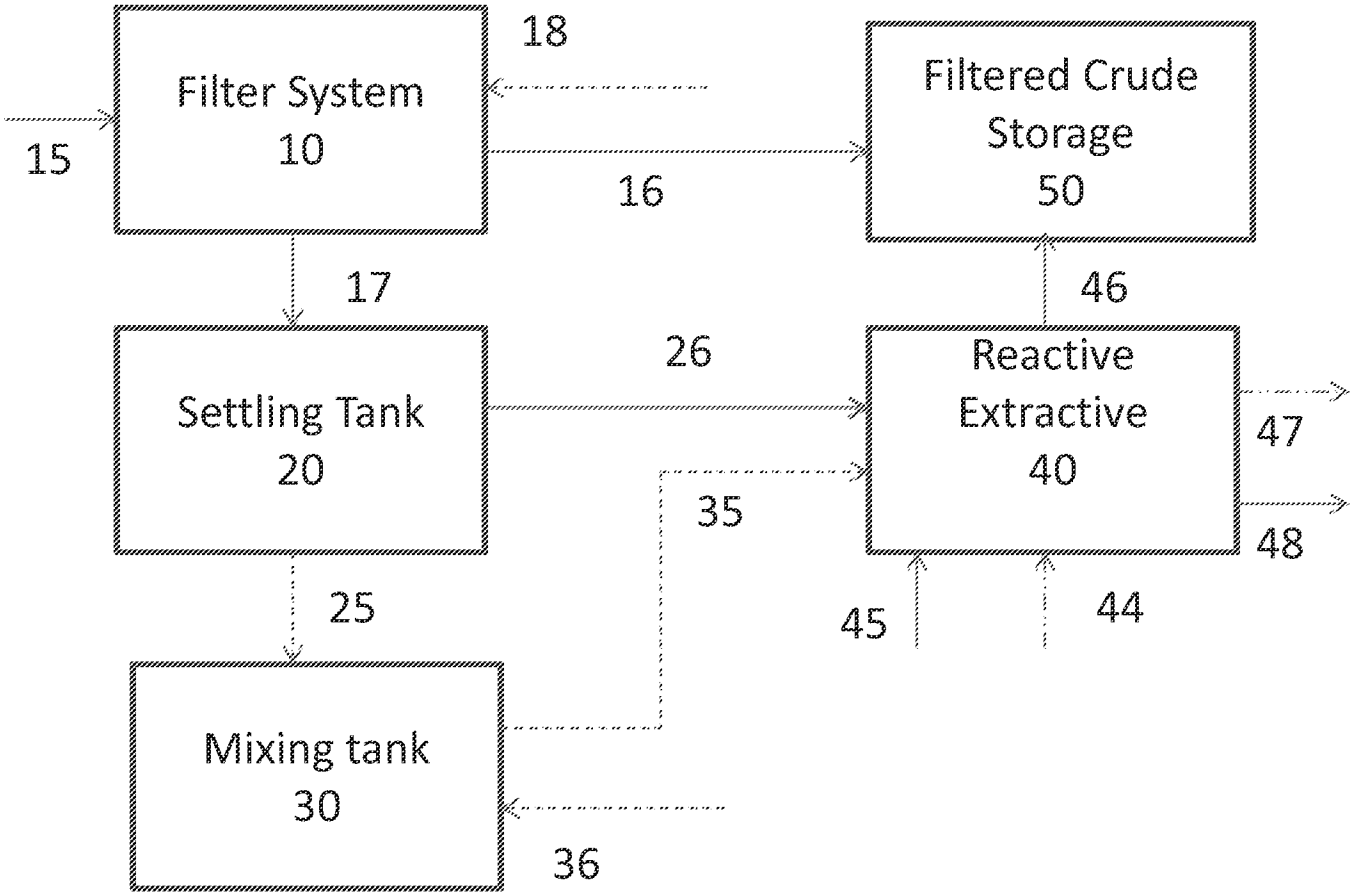
Filter System
10
Settling Tank
20
Mixing tank
30
Filtered Crude
Storage
50
Reactive
Extractive
40
15
16
17
18
25
26
35
36
44
45
46
47
48

PROCESS, METHOD, AND SYSTEM FOR REMOVING HEAVY METALS FROM FLUIDS

CROSS-REFERENCE TO RELATED APPLICATIONS

NONE

TECHNICAL FIELD

The invention relates generally to a process, method, and system for removing heavy metals such as mercury from liquid hydrocarbons.

BACKGROUND

Heavy metals such as mercury can be present in trace amounts in all types of hydrocarbon streams such as crude oils. The amount can range from below the analytical detection limit to several thousand ppbw (parts per billion by weight) depending on the source. It is desirable to remove the trace amounts of these metals from crude oils.

Various methods to remove trace metal contaminants in liquid hydrocarbon feed such as mercury have been disclosed.

U.S. Pat. Nos. 6,537,443 and 6,685,824 disclose processes for removing mercury, in which the liquid hydrocarbon feed is mixed with sulfur containing compounds, and removing the mercury-containing particulates in a pre-coated pressure filter. A filtering process is compact, but it may result in loss of hydrocarbons and waste in the form of oily solids. In US Patent Publication Nos. US20120067785A1, US20120067784A1, US20120125816A1, reactive extraction methods are employed, wherein the liquid hydrocarbon feed stream is brought into contact with additives including but not limited to an iodine source, tetrakis(hydroxymethyl) phosphonium sulfate/tetrakis(hydroxymethyl) phosphonium chloride, and oxidizing agents, respectively, wherein mercury is extracted from the crude oil into a water phase for subsequent removal.

There is a need for improved methods and systems for the removal of mercury from liquid hydrocarbon steams, particularly a compact system maximizing oil recovery and using lower quantities of chemical reagents than in prior art methods.

SUMMARY

In one aspect, a method for reducing a trace element of mercury in a crude oil feedstock is provided. The method comprises the steps: passing the crude oil feedstock having a mercury concentration as feed to a filtration device having a filter element to generate a filtered crude having a reduced concentration of mercury and a reject stream containing crude oil having a concentrated mercury level of at least 10 times the concentration of mercury in the crude oil feed; mixing into the reject stream an effective amount of an extractive agent to remove a portion of the mercury for a treated crude oil having a reduced concentration of mercury.

In one embodiment, the filtration device is a dead-end filter, and the device is back-flushed to generate the reject stream. In another embodiment, the device is a cross-flow filtration which generates a permeate stream comprising the filtered crude, and the reject stream comprising a retentate stream having a mercury concentration of at least 20 times the concentration of mercury in the crude oil feedstock.

In another aspect, a method for removing a trace amount of mercury in liquid hydrocarbons is disclosed. The process comprises: passing the crude oil feed through a filtration device having a filtration element to retain at least 50% of the mercury on the filtration media and generate a filtered crude having a reduced concentration of mercury; back-flushing the filtration device with a portion of the filtered crude to generate a reject stream containing crude oil having a concentrated mercury level of at least 20 times the concentration of mercury in the filtered crude; mixing into the reject stream an effective amount of an extractive agent selected from the group of tetrakis(hydroxymethyl) phosphonium sulfate; tetrakis(hydroxymethyl)phosphonium chloride; an oxidizing agent; an organic or inorganic sulfidic compound with at least one sulfur atom reactive with mercury; and combinations thereof to extract a portion of the mercury into a water phase; and separating the water phase containing the mercury from the crude oil for a treated crude oil having a reduced concentration of mercury.

In one embodiment, the filtration device is a cross-flow filtration device. In another embodiment, the filtration device is a dead-end filtration device having the filtration element pre-coated with a filter aid material, e.g., materials including but not limited to pearlite, diatomite, cellulose fiber, and combinations thereof.

In another aspect, a method for removing a trace amount of mercury in liquid hydrocarbons is disclosed. The process comprises the steps of: passing the crude oil feed through a dead-end filtration device to retain at least 50% of the mercury on the filtration media and generate a filtered crude having a reduced concentration of mercury; back-flushing the filtration device with a portion of the filtered crude or other solvents to generate a reject stream having a concentrated mercury level of at least 20 times the concentration of mercury in the filtered crude; mixing into the reject stream an effective amount of a reducing agent to convert a portion of the mercury into a volatile form of mercury; and removing a portion of the volatile mercury by at least one of stripping, scrubbing, adsorption, and combinations thereof to obtain a treated crude oil having a reduced concentration of mercury.

DRAWINGS

FIG. 1 is a block diagram of embodiments of a system and a process to remove mercury from oily solids.

DETAILED DESCRIPTION

The following terms will be used throughout the specification and will have the following meanings unless otherwise indicated.

"Crude oil" refers to both crude oil and condensate. Crude, crude oil, crudes and liquid hydrocarbons are used interchangeably and each is intended to include both a single crude and blends of crudes.

"Trace amount" refers to the amount of mercury in the crude oil, which varies depending on the source, e.g., from a few ppb to up to 30,000 ppb.

"Dead-end filtration" (conventional or normal filtration) refers to a filter system where substantially the entire liquid portion of the slurry, rather than just a fraction, is forced through the filter element, with most or all of the solids retained on the filter element as filter cake.

"Cross-flow" filtration (or crossflow filtration or tangential flow filtration (TFF)) refers to a filtration technique in which the feed stream flows parallel or tangentially along the surface of the filter element (membrane) and the filtrate flows across the filter element, and typically only a portion of the liquid in the solids-containing stream passes through the filter element. In cross-flow filtration, solid material which is smaller than the filter element pore size passes through (across) the element as permeate or filtrate, and everything else is retained on the feed side of the element as retentate or concentrate.

"Diafiltration" (DF) refers to a cross-flow filtration process wherein a buffer material, e.g., a solvent, is added into the feed stream and/or the filtering process while filtrate is removed continuously from the process.

"Dynamic filtration" is an extension of cross-flow filtration, wherein the filter medium is kept essentially free from plugging or fouling by using rotary, oscillating, or vibratory motion of the filtration membrane relative to the feed slurry to disrupt the formation of cake layers adjacent to the filter medium. These results are accomplished by moving the material being filtered fast enough relative to the filtration medium to produce high shear rates as well as high lift forces on the particles.

As used herein, the term cross-flow filtration (or filter) includes diafiltration and dynamic filtration techniques/apparatuses.

Crudes may contain small amounts of mercury, which may be present as elemental mercury $Hg^0$, ionic mercury, inorganic mercury compounds, and/or organic mercury compounds. Examples include but are not limited to: mercuric halides (e.g., HgXY, X and Y could be halides, oxygen, or halogen-oxides), mercurous halides (e.g., $Hg_2XY$, X and Y could be halides, oxygen, or halogen-oxides), mercuric oxides (e.g., HgO), mercuric sulfide (e.g., HgS, meta-cinnabar and/or cinnabar), mercuric sulfate ($HgSO_4$), mercurous sulfate ($Hg_2SO_4$), mercury selenide (e.g., $HgSe_2$, $HgSe_8$, HgSe), mercury hydroxides, and organo-mercury compounds (e.g., alkyl mercury compounds) and mixtures of thereof.

The invention relates to the removal of trace mercury in crude oil in a mercury removal process comprising a filtration step and a reactive extraction step, for a compact system requiring less chemical reagents than in the prior art.

Filtration Process Step: In one embodiment, the liquid hydrocarbon is first treated in a filtration process step, wherein a portion of mercury particulate mercury and solids containing adsorbed mercury are removed.

In one embodiment, the system comprises a dead-end filtration device selected from the group of sand filter, multimedia filter, cartridge filter, bag filter, employing a filter element (membrane), employed in a form known in the art, e.g., cartridges, screens, bags, pleated filter, spiral wound filters, etc. As the crude is forced through the filter element by pressure drop, e.g., between 5 to 50 psig, solids as well as mercury containing particulates deposit on the filter element(s), resulting in a crude with a reduced concentration of mercury.

In one embodiment, the filter element is a stainless steel sintered metal filter with no pre-coating, having pore size ranges from 0.5 to 5 microns. In another embodiment, the filter element is pre-coated with a filter aid material known in the art, e.g., pearlite, diatomite (diatomaceous earth or "DE"), cellulose fiber, or combinations thereof. The filter aid material has a median particle size of 0.1 to 100 μm and at a thickness of at least 1 mm in one embodiment; a median particle size ranging from 1 to 50 μm in a second embodiment; and from 3 to 20 μm in a third embodiment. In one embodiment, the filter aid layer has a thickness of 2-10 mm. In yet another embodiment, the filter aid layer has a thickness of less than 1" (2.54 cm). The filter aid material has a median particle size ranging from 1 to 50 μm in one embodiment; and from 3 to 20 μm in a second embodiment.

In another embodiment, the filter system comprises a cross-flow filter device. The cross-flow device is of the dynamic filtration type in one embodiment. In a second embodiment, the cross-flow filter device is of a vibratory shear enhanced processing (VSEP) filter type from New Logic Research, Inc. of Emeryville, Calif. and similar devices from other manufacturers. The cross-flow filter device separates a mercury containing crude feed into two streams, a first stream which passes through the filter membrane containing crude with a reduced mercury concentration ("permeate stream"), and a second stream ("retentate stream") with the remainder of the crude feed, solids, and particulates, which does not pass through the filter membrane, having mercury concentration of at least 10-50 times the mercury concentration in the first stream.

In one embodiment of a cross-flow filtration operation, a portion of the retentate stream is recycled and combined with the liquid hydrocarbon feed to the cross-flow filter. The amount of the recycle stream in the recirculation loop can be varied to allow further concentration of the mercury in the reject (retentate) stream, provide buffer from process upsets, and control of the concentration in the reject stream for further Hg removal treatment. A portion of the retentate stream ranging from 1 to 25% of the total stream can be continuously or periodically purged from the cross-flow filtration process as a reject stream, allowing control of the amount of mercury and other matters from the system. In one embodiment, a portion the retentate stream equivalent to about 1-10% of the feed to the filtration system is purged for further treatment in the reactive extraction process step.

Any suitable filtration element (membrane) can be utilized in the crossflow or dead-end filtration assembly. In one embodiment, the filter element comprises a porous material which permits crude oil and solids below a certain size to flow through as the filtrate (or permeate) while retaining particles, including mercury-containing particles, in the retentate. The filter membrane is of sufficient nominal pore size for at least 50% of the crude to pass through in one embodiment; at least 60% in a second embodiment; at least 70% in a third embodiment; and at least 80% in a fourth embodiment. The filter membrane has a pore size of 0.1-50 μm in one embodiment; of 0.5-20 μm in a second embodiment; and at least 1 μm in a third embodiment.

Polymers, organic materials, inorganic ceramic materials, and metals are suitable for use as construction materials for the membrane in the cross-flow filtration device, or the filter element in the dead-end filtration device, as long as it does not undergo significant chemical changes to substantially impair the desired properties of the filtered crude. In one embodiment, the material is an inorganic material such as a ceramic (silicon carbide, zirconium oxide, titanium oxide, etc.) having the ability to withstand harsh environments. In another embodiment, the material is a metal such as stainless steel, titanium, or nickel-copper alloy.

Over time, filtration becomes more difficult as pressure builds up across the filter apparatus with the filter element being clogged up with particulates. The filter is periodically (or whenever needed as clogged) back-flushed to remove oily solids, which comprise filtered particulates and pre-coated filter aid material (if any was applied). In one embodiment, the back-flushing is carried out by reversing the flow direction of the filtrate stream to force oily solids off the membrane/screen, generating a reject stream. In another embodiment, the trans-membrane pressure is periodically inverted by the use of a secondary pump. In one embodiment, the filter device is back-flushed with a fluid to force the filtered particulates and filter aid materials (if any was applied) off the filter element and out of the filter system. This back flushing also forces a portion of the hydrocarbon liquids out of the filter system with the solids as a reject stream.

In one embodiment, a gas, e.g., methane, nitrogen, carbon dioxide, etc., is used for the back-flushing. In another embodiment, in addition to or in place of using a gas, the filtered crude or a solvent (or a mixture thereof) is used to extract the oily solids. The extraction solvent is a light specific gravity solvent or solvent mixtures, such as, for example, xylene, benzene, toluene, kerosene, reformate (light aromatics), light naphtha, heavy naphtha, light cycle oil (LCO), medium cycle oil (MCO), propane, diesel boiling range material, which is used to "wash" the filter membrane/screen/filter aid and remove the oily solids, generating a reject stream.

In one embodiment of a cross-flow filtration operation, instead of or in addition to periodic back-flushing with a gas, the filtered crude, or an extracting solvent, a small amount of the solvent is optionally added to the feed stream to be filtered, with the weight ratio of the solvent being slowing increasing overtime to facilitate the filtration operation or decreasing the frequency of back-flushing. The solvent feed is added in a weight ratio of solvent to feed of 0 at the start of the filtering operation, to 10:1 toward the end of the operation as the pressure begins to build up as the membrane becomes clogged.

In one embodiment, the filter device comprises a plurality of filter elements with means within the assembly for back-flushing at least one of the filter screens/membranes without interrupting the operation while the device is on-stream, with the back-flushed device being isolated from the crude feed. In yet another embodiment, the filter device is of a clean-in-place (CIP) type known in the art, with accessory pumps, holding tanks, and the like supplying solvents and/or reactive agents such as sodium hypochlorite and sulfidic compounds to alleviate fouling and pressure build-up in the filtration system.

Descriptions and operations of filter devices that can be used in the filtration process step include and are not limited to US patent publications US20120132597A1 titled "Cross-flow filtration with turbulence and back-flushing action for use with online chemical monitors," US8128829 titled "Cross flow filter device," US3994810 titled "Onstream back-flush filter," and US5587074 titled "Fluid filter with enhanced back-flush flow," US6322698 titled "Vibratory separation systems and membrane separation units," the relevant disclosures are incorporated herein by reference.

In one embodiment and in addition to filtration, the liquid hydrocarbon is optionally treated with an organic or inorganic sulfidic compound with at least one sulfur atom reactive with mercury as disclosed in U.S. Pat. Nos. 6,537,443 and 6,685,824, the relevant disclosures are incorporated herein by reference. In one embodiment, the sulfidic compound when dissolved in water yields $S^{2-}$, $SH^-$, $S_x^{2-}$, or $S_xH^-$ anions, and a solution with a pH greater than 7. Exemplary sulfidic compounds include but are not limited to potassium or sodium sulfide ($Na_2S$), sodium hydrosulfide (NaSH), potassium or sodium polysulfide ($Na_2Sx$), ammonium sulfide [$(NH_4)_2S$], ammonium hydrosulfide ($NH_4HS$), ammonium polysulfide [$(NH_4)_2Sx$], Group 1 and Group 2 counterparts of these materials, and combinations thereof. The treating sulfidic compound is added for a concentration of 1.0 and about 10000 ppbw in one embodiment; and about 5.0 ppbw and about 1000 ppbw in a second embodiment.

In one embodiment, the sulfidic treatment is in-situ in the filtering operation with the use of filter aid materials pretreated or coated with the organic or inorganic sulfidic compound. In another embodiment, the crude feed is mixed with the sulfidic compound prior to the filter operation, in an in-line static mixer or a mixing tank with a residence time of at least 1 minute, wherein any mercury precipitate formed is removed in the filtration step. In another embodiment, the mixing time is at least 15 minutes.

Depending on the initial concentration of mercury in the liquid hydrocarbon feed, the filtration step results in two streams, a first stream for further mercury removal ("reject stream") containing optional extract solvent, oily solids, and less than 10 vol. % of the original crude feed with a mercury concentration of much higher than in the original crude feed; and a second stream with filtered crude containing at least 90 vol. % of the original crude feed, for further processing or sale.

The reject stream has a mercury concentration of at least 20 times the concentration of mercury in the filtered crude in one embodiment; at least 50 times in a second embodiment; at least 100 times in a third embodiment; and at least 1000 times in a fourth embodiment. The first stream has a mercury concentration of at least 5 times the mercury concentration in the original crude feed in one embodiment; at least 10 times in a second embodiment; and at least 100 times in a third embodiment.

The filtered crude stream has a reduced mercury concentration of less than 1000 ppbw in one embodiment; less than 500 ppbw in a second embodiment; less than 300 ppbw n a third embodiment; less than 100 ppbw in a third embodiment; and less than 50 ppbw in a fourth embodiment. With optional treatment with a sulfidic compound, the mercury in the filtered crude is reduced to less than 100 ppbw in one embodiment; less than 75 ppbw in a second embodiment; and less than 50 ppbw in a third embodiment.

Reactive Extraction Process Step: The reject stream, i.e., the crude with a concentrated mercury level is further treated with chemical reagents to lower its mercury level. In the reactive extraction process, the reject stream is brought into contact with one or more extractive agents selected from the group of tetrakis(hydroxymethyl)phosphonium sulfate; tetrakis(hydroxymethyl)phosphonium chloride; an oxidizing agent; an organic or inorganic sulfidic compound with at least one sulfur atom reactive with mercury; and combinations thereof. In one embodiment, a solvent such as water may also be added along with the extractive agent. The extractive agent extracts a portion of mercury into the water phase for subsequent removal in a phase separation process step. At least 50% of the mercury is extracted from the crude oil into the water phase in one embodiment; at least 75% extraction in a second embodiment; at least 90% extraction in a third embodiment.

In another embodiment, the crude is treated with a reducing agent ("reductant") as an extractive agent, wherein the reductant coverts at least 25% of the non-volatile mercury portion of the mercury to a volatile (strippable) form. The mercury is then removed from the crude via stripping with a stripping gas known in the art, e.g., natural gas, methane, nitrogen, or combinations thereof.

The extractive agent can be employed in any form of a liquid, a powder, slurry, aqueous form, a gas, a material on a support, or combinations thereof. Different extractive agents can be added, e.g., in one embodiment after the addition of an oxidant, a reducing agent is added. In another embodiment, the crude is brought into contact directly with a reducing agent without any oxidant addition.

The amount of extractive agent needed for mercury removal is at least equal to the amount of mercury to be removed on a molar basis (1:1), if not in an excess amount. In one embodiment, the molar ratio ranges from 2:1 to 5,000:1.

In another embodiment, from 10:1 to 2,500:1. In yet another embodiment, the molar ratio ranges from 5:1 to 10,000:1.

The contact with the extractive agent can be at any temperature that is sufficiently high enough for the crude to be liquid. The contact is at room temperature in one embodiment; at a sufficiently elevated temperature, e.g., at least 50° C., in another embodiment; for at least a minute in one embodiment; at least 1 hr in another embodiment; and at least 2 hrs. in yet another embodiment.

The contact between the reject stream with concentrated mercury level and the extractive agent can be either via a non-dispersive or dispersive method. The dispersive contacting method can be via mixing valves, static mixers or mixing tanks or vessels, or other methods known in the art. The non-dispersive method can be any of packed inert particle beds, fiber film contactors, or other method known in the art.

In one embodiment, the extractive agent is an organic or inorganic sulfidic compound, which converts or extracts non-volatile mercury from the crude oil to a water-soluble form. The reactive extractive agent can be the same or different sulfur compound used in the filtration process (if any was used). Examples include but are not limited to alkali metal sulfides, alkaline earth metal sulfides, alkali metal polysulfides, alkaline earth metal polysulfides, alkali metal trithiocarbonates, dithiocarbamates, either in the monomeric or polymeric form, sulfurized olefins, mercaptans, thiophenes, thiophenols, mono and dithio organic acids, and mono and dithioesters, and mixtures thereof. In one embodiment, the sulfidic compound is water-soluble monatomic sulfur compound, e.g., any of sodium hydrosulfide, potassium hydrosulfide, ammonium hydrosulfide, sodium sulfide, potassium sulfide, calcium sulfide, magnesium sulfide, and ammonium sulfide.

In another embodiment, the extractive agent is an oxidizing agent ("oxidant") to extract mercury from the crude oil forming a soluble mercury compound. The oxidant in one embodiment is selected from the group of iodine sources, oxyhalites, hydroperoxides, organic peroxides, inorganic peracids and salts thereof, organic peracids and salts thereof, ozone, and combinations thereof. In one embodiment, the oxidant is selected from the group of elemental halogens or halogen containing compounds, e.g., chlorine, iodine, fluorine or bromine, alkali metal salts of halogens, e.g., halides, chlorine dioxide, etc. In another embodiment, the oxidant is an iodide of a heavy metal cation. In yet another embodiment, the oxidant is selected from ammonium iodide, an alkaline metal iodide, and etheylenediamine dihydroiodide. In one embodiment, the oxidant is selected from the group of hypochlorite ions ($OCl^-$ such as NaOCl, $NaOCl_2$, $NaOCl_3$, $NaOCl_4$, $Ca(OCl)_2$, $NaClO_3$, $NaClO_2$, etc.), vanadium oxytrichloride, Fenton's reagent, hypobromite ions, chlorine dioxine, iodate $IO_3^-$ (such as potassium iodate $KIO_3$ and sodium iodate $NaIO_3$), and mixtures thereof. In one embodiment, the oxidant is selected from $KMnO_4$, $K_2S_2O_8$, $K_2CrO_7$, and $Cl_2$.

In one embodiment, the extractive agent is a reducing agent ("reductant"), which can be added as the only extracting agent. In another embodiment, the reducing agent is added in addition to the oxidizing agent (and other optional reagents such as demulsifiers) for a portion of the mercury to be converted from a non-volatile to a volatile form. The oxidant/reductant can be introduced continuously, e.g., in a water stream being brought into contact continuously with a crude oil stream, or intermittently, e.g., injection of a water stream batch-wise.

Examples of reducing agents include but are not limited to reduced sulfur compounds contain at least one sulfur atom in an oxidation state less than +6. (e.g., sodium thiosulfate, sodium or potassium bisulfate, metabisulfite, or sulfite); ferrous and ferric compounds include inorganic and organic ferrous compounds; stannous compounds which include inorganic stannous compounds and organic stannous compounds; oxalates which include oxalic acid, inorganic oxalates and organic oxalates; cuprous compounds include inorganic and organic cuprous compounds; organic acids decompose to form CO2 upon heating and act as reducing agents; nitrogen compounds include hydroxylamine compounds and hydrazine; sodium borohydride; diisobutylaluminium hydride (DIBAL-H); thiourea; a transition metal halide such as ferric chloride, zinc chloride, $NiCl_2$; $SO_2$ in $N_2$ or other inert gases, hydrogen; hydrogen sulfide; and hydrocarbons such as $CO_2$ and carbon monoxide.

After the addition of an extractive agent that converts some of the mercury in the concentrated crude to a soluble form, e.g., iodine source or an oxidant, the treated crude having a reduced concentration of mercury can be separated from the aqueous phase containing the extracted mercury by methods known in the art, e.g., gravity settling, coalescing, etc., using separation devices such as centrifuges, hydrocyclones, separators, mesh coalescer etc.

In one embodiment, the removal of mercury from the treated crude can be enhanced with the addition of a complexing agent to the oil-water emulsion mixture, added in a sufficient amount to effectively stabilize (forming complexes with) the soluble mercury. This amount as expressed as molar ratio of complexing agent to soluble mercury ranges from 1:1 to 5,000:1 in one embodiment; from 5:1 to 1000:1 in a second embodiment; and 10:10 to 500:1 in a third embodiment. Mercury forms coordination complexes with compounds including but not limited to oxygen, sulfur, phosphorous and nitrogen containing compound, e.g., thiol groups, thiophene groups, thioether groups, thiazole groups, thalocyanine groups, thiourenium groups, amino groups, polyethylene imine groups, hydrazido groups, N-thiocarbamoyl-polyalkylene polyamino groups, derivatives thereof, and mixtures thereof. In another embodiment, the complexing agent is an inorganic sulfur compound selected from sulfides, ammonium thiosulfate, alkali metal thiosulfates, alkaline earth metal thiosulfates, iron thiosulfates, alkali metal dithionites, and alkaline earth metal dithionites, and mixtures thereof. In yet another embodiment, the complexing agent is a polyamine for forming stable cationic complexes with mercury ions.

In one embodiment with the use of a reductant as a extractive agent, the volatile mercury is stripped from the treated crude oil using methods and equipment known in the art, e.g., a stripping unit, an adsorption bed, etc. In one embodiment, the crude oil is sent to a stripping unit with the addition of a stripping (carrier) gas for the removal of the volatile mercury from the crude into the stripping gas. The crude removed from the bottom of the unit contains less than 50% of the mercury originally in the crude (both volatile and non-volatile forms) in one embodiment.

The treated crude oil can be combined with the filtered crude oil to form a combined crude oil product stream having a reduced concentration of mercury, e.g., less than 100 ppbw in one embodiment. The combined crude oil product stream in one embodiment is at least 95% volume of the crude oil feedstock to the filtration unit; and at least 98 vol. % in a second embodiment.

Stripping of Volatile Mercury: In one embodiment, with the conversion of a portion the mercury from a non-volatile to a volatile form, the volatile mercury is stripped from the reject stream while it is in contact with the extracting agents, e.g., oxidant and/or reductant, with a stripping (carrier) gas. In another embodiment, the volatile mercury is removed from the treated crude using methods and equipment known in the art, e.g., a stripping unit, an adsorption bed, etc.

After treatment with the extractive agents, the concentration of mercury in the treated crude oil is reduced to 100 ppbw or less in one embodiment; 50 ppbw or less in a second embodiment; 20 ppbw or less in a third embodiment; and less than 10 ppbw in a fourth embodiment. In yet another embodiment, at least 75% of the mercury is extracted from the crude oil in the reject stream. In another embodiment, the removal or the reduction is at least 90%.

Examples of extractive agents and methods for mercury removal using extractive agents are disclosed in US Patent Publication Nos. US20120125816A1, US20120125817A1, US20120125818A1, US20120067784A1, US20120067785A1, US20120067786A1, and US20120067779A1, the relevant disclosures are incorporated herein by reference.

Figure Illustrating Embodiments: Reference will be made to FIG. 1 for a diagram schematically illustrating various embodiments of a system for removing mercury from oily solids.

In FIG. 1, a crude oil stream containing mercury 15 is sent to filtration system 10, which in one embodiment is a bank of filter elements in the form of dead-end filtration or cross-flow filtration. In one embodiment, a gas stream 18 is used for the back-flushing of the filter element. In another embodiment, an extraction solvent stream is used for the back-flushing instead of or in addition to the gas stream 18. Although not shown, in one embodiment, the filtration system includes a recirculation loop with one or more recirculation pumps for the recycling of the retentate stream, with a portion of the retentate stream being purged from the recycled retentate stream continuously or periodically to form the reject stream for further treatment. The filtered crude 16 with a reduced concentration of mercury is sent to storage tank 50 for sale or further treatment. The reject stream 17 containing the back-flushed crude and/or the purged portion of the retentate stream is sent to settling tank 20. The reject stream 17 has a mercury concentration of 2-50 times the concentration of mercury in the feed stream 15.

In one embodiment of an oxidation-complexation process for the removal of mercury (as shown in dotted lines), at least an oxidizing agent 36 is added to the reject stream 25 in a mixing tank 30, and the mixture of oxidizing agent and crude oil 35 is directed to the reactive extraction process step 40, with the addition of an aqueous stream containing reducing/complexing reagent 45. Waste water 47 containing mercury is sent to disposal or re-injected into a reservoir, and crude 46 with reduced mercury content is sent to storage 50.

In another embodiment with the use of direct reduction for the removal of mercury (solid lines), from the settling tank 20, stream 26 containing back-flushed crude and/or purged retentate stream is directed to the reactive extraction process step 40, wherein at least an aqueous stream containing a reducing agent 45 is added for the conversion wherein a portion of non-volatile mercury is converted to volatile strippable mercury. In one embodiment, a stripping gas 44, e.g., $N_2$, $CO_2$, $H_2$, methane, argon, helium, steam, natural gas, and combinations thereof is employed to remove the volatile mercury. From this process step, gas stream 48 containing mercury is sent to disposal, re-injected into a reservoir or treated with an adsorbent material by methods known in the art for mercury removal from gas streams. Crude 46 with reduced mercury content is sent to storage 50.

In a third embodiment of a sulfidic extraction process for the removal of mercury (as shown in dotted lines), an aqueous stream 45' containing an inorganic sulfidic compound is added to the extraction step 40 for the conversion of or extraction of non-volatile mercury from the crude oil stream 26 to a water-soluble form. Waste water 47 containing water-soluble mercury is sent to disposal or re-injected into a reservoir, and crude 46 with reduced mercury content is sent to storage 50.

The system as illustrated can be any of a mobile unit, located on-shore such as in a refinery, or off-shore on a facility such as an FPSO or other offshore facility for the production of oil and/or gas.

EXAMPLES

The illustrative examples are intended to be non-limiting.

Examples 1-2

Different 50° API crude and 55° API natural gas condensate samples with starting Hg concentration ranging from 588 to 2200 ppbw are processed using cross-flow filtration conducted at 175° C. and 75 psig, employing a Teflon® on Woven Fiberglass membrane having a pore size of 1 μm. The retentate is recycled back to the filter system in a recirculation loop with the use of a recirculation pump to combine with the feed to the system. The recirculation pump also maintains a sufficient velocity through the tubes of the filter housing (greater than 10 feet/second) to avoid membrane fouling. A portion of the retentate in an amount of about 2-10% the feed to filtration system is continuously purged from the system. The filtered products are expected to have a mercury concentration of less than 100 ppbw. The purged retentate is expected to have a concentration of 10-50 times the mercury concentration of the feed to the filter system.

Example 3

The filtration in Examples 1-2 continues until there is a substantial pressure build-up, e.g., going from 10-15 psi at the beginning to 25-30 psi. The filter element is back-flushed with nitrogen, along with a small amount of the filtered oil. The back-flushed oil samples are placed into centrifuge tubes, shaken by hand vigorously for about 2 minutes. The back-flushed oil samples are expected to have a concentrated mercury level of at least 10,000 ppwb, if not at least 50,000 ppbw.

Example 4

Various samples of 50 mL of the back-flushed oil with concentrated mercury level in Example 3 are combined with the purged retentate streams, and added to a number of 10 mL Teflon-capped centrifuge tubes. Different oxidants are as shown in Table 2. The tubes are shaken vigorously for about 2 minutes. 5 mL of distilled water is added to tube. A predetermined volume of TETREN as complexing agent is added for a final concentration of 30 μM. Tubes are again shaken by hand vigorously for about 2 minutes, then centrifuged for 1 minute to separate oil from water. Aliquots of both oil and water from each are analyzed for mercury with resulting concentrations as listed in Table 2. It is expected that the mercury removal efficiency is as previously obtained in US Patent Publication No. 20120125817.

TABLE 2

| No. | Oxidant | Dosage ppbw | Hg in oil ppb | Hg in water ppb | Hg removal % |
|---|---|---|---|---|---|
| 1 | None - control | — | >10,000 | <1000 | 3.7 |
| 2 | Iodine | 1000 | <100 | >1000 | >90 |
| 3 | Sodium polysulfide | 29,000 | <100 | >1000 | >90 |
| 4 | Oxone ™ | 7260 | <150 | >1000 | >80 |
| 5 | Iodine | 7260 | <150 | >1000 | >80 |

For the purposes of this specification and appended claims, unless otherwise indicated, all numbers expressing quantities, percentages or proportions, and other numerical values used in the specification and claims are to be understood as being modified in all instances by the term "about." Accordingly, unless indicated to the contrary, the numerical parameters set forth in the following specification and attached claims are approximations that can vary depending upon the desired properties sought to be obtained by the present invention. It is noted that, as used in this specification and the appended claims, the singular forms "a," "an," and "the," include plural references unless expressly and unequivocally limited to one referent.

As used herein, the term "include" and its grammatical variants are intended to be non-limiting, such that recitation of items in a list is not to the exclusion of other like items that can be substituted or added to the listed items. The terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Unless otherwise defined, all terms, including technical and scientific terms used in the description, have the same meaning as commonly understood by one of ordinary skill in the art to which this invention belongs.

This written description uses examples to disclose the invention, including the best mode, and also to enable any person skilled in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims. All citations referred herein are expressly incorporated herein by reference.

The invention claimed is:

1. A method for reducing a trace element of mercury in a crude oil feedstock, comprising: passing the crude oil feedstock having a first mercury concentration as feed to a filtration device having at least a filter element to generate a filtered crude having a reduced concentration of mercury and a reject stream containing crude oil having a concentrated mercury level of at least 10 times the concentration of mercury in the crude oil feed; mixing into the reject stream an effective amount of an extractive agent to remove at least a portion of the mercury for a treated crude oil having a reduced concentration of mercury.

2. The method of claim 1, where the treated crude oil is combined with the filtered crude oil to form a combined product stream having a mercury concentration of less than 100 ppbw.

3. The method of claim 2, wherein the combined product stream is at least 98 vol. % of the crude oil feedstock.

4. The method of claim 1, wherein the extractive agent is selected from the group of oxidizing agents; reducing agents, organic or inorganic sulfidic compounds with at least one sulfur atom reactive with mercury; tetrakis(hydroxymethyl) phosphonium sulfate; tetrakis(hydroxymethyl)phosphonium chloride; and combinations thereof.

5. The method of claim 1, wherein the extractive agent extracts a portion of the mercury into a water phase, and wherein the method further comprises:

separating the water phase containing the mercury from the crude oil for the treated crude oil to have a concentration of mercury of less than 100 ppbw.

6. The method of claim 1, wherein the filtration device is periodically back-flushed to generate the reject stream.

7. The method of claim 6, wherein the filtration device is back-flushed with any of: an extraction solvent; a portion of the filtered crude; a gas selected from methane, nitrogen, carbon dioxide; and combinations thereof to generate the reject stream.

8. The method of claim 1, wherein the filtration device is a dead-end filtration device and wherein at least 50% of the mercury is retained on the filter element.

9. The method of claim 8, wherein the filter element is pre-coated with a filter aid material.

10. The method of claim 9, wherein the filter aid material has a median particle size of 0.1 to 100 μm and the filter aid pre-coat is at least 1 mm thick.

11. The method of claim 9, wherein the filter aid material has a median particle size of 3 to 20 μm and the filter aid pre-coat has a thickness of 2-10 mm.

12. The method of claim 9, wherein the filter aid material is selected from pearlite, diatomite, cellulose fiber, and combinations thereof.

13. The method of claim 9, wherein the filter aid material is diatomite pretreated with an organic or inorganic sulfidic compound with at least one sulfur atom reactive with mercury.

14. The method of claim 1, wherein the filtration device is a cross-flow filter device which generates a permeate stream comprising the filtered crude, and the reject stream comprising a retentate stream.

15. The method of claim 14, wherein at least a portion of the retentate stream is purged to generate the reject stream.

16. The method of claim 14, wherein the cross-flow filtration device generates a permeate stream comprising the filtered crude having a reduced concentration of mercury, and a retentate stream having a mercury concentration of at least 10 times the first concentration of mercury.

17. The method of claim 14, wherein a portion of the retentate stream is recycled in a recirculation loop and combined with the crude oil feedstock as feed to the filtration device.

18. The method of claim 14, wherein the permeate stream has a reduced concentration of mercury of less than 100 ppbw.

19. The method of claim 14, wherein the cross-flow filtration device is periodically back-flushed with an extraction solvent to generate a back-flushed stream, and wherein the back-flushed stream is added to the retentate stream to generate the reject stream.

20. The method of claim 1, wherein the filtration device is a dynamic filtration device.

21. The method of claim 20, wherein the dynamic filtration device is a vibratory shear enhanced processing filter.

22. The method of claim 1, wherein the extractive agent is an organic or inorganic sulfidic compound selected from the group of alkali metal sulfides, alkaline earth metal sulfides, alkali metal polysulfides, alkaline earth metal polysulfides, alkali metal trithiocarbonates, dithiocarbamates, either in the monomeric or polymeric form, sulfurized olefins, mercaptans, thiophenes, thiophenols, mono and dithio organic acids, and mono and dithioesters, and mixtures thereof.

23. The method of claim 1, wherein the extractive agent is a water-soluble monatomic sulfur compound selected from the group of sodium hydrosulfide, potassium hydrosulfide, ammonium hydrosulfide, sodium sulfide, potassium sulfide, calcium sulfide, magnesium sulfide, ammonium sulfide, and mixtures thereof.

24. The method of claim 1, wherein the extractive agent is an oxidant selected from the group of iodine sources, oxyhalites, hydroperoxides, organic peroxides, inorganic peracids and salts thereof, organic peracids and salts thereof, ozone, hypochlorite ions, vanadium oxytrichloride, Fenton's reagent, hypobromite ions, chlorine dioxine, iodate $IO_3^-$, and mixtures thereof.

25. The method of claim 2, further comprising:

mixing a complexing agent into the mixture of the reject stream and the extractive agent, wherein the complexing agent is selected from the group of thiol groups, thiophene groups, thioether groups, thiazole groups, thalocyanine groups, thiourenium groups, amino groups, polyethylene imine groups, hydrazido groups, N-thiocarbamoyl-polyalkylene polyamino groups, sulfides, ammonium thiosulfate, alkali metal thiosulfates, alkaline earth metal thiosulfates, iron thiosulfates, alkali metal dithionites, and alkaline earth metal dithionites, polyamines, and mixtures thereof.

26. The method of claim 6, wherein the filtration device is back-flushed with a portion of the filtered crude in an amount of less than 10 vol. % of the crude oil feed.

27. The method of claim 1, wherein the reject stream has a mercury level of at least 50 times the concentration of mercury in the crude oil feed.

28. The method of claim 26, wherein the filtered crude contains less than 100 ppbw mercury.

29. The method of claim 27, wherein the filtered crude contains less than 50 ppbw mercury.

30. The method of claim 1, wherein the treated crude contains less than 100 ppbw mercury.

31. A method for reducing a trace element of mercury in a crude oil feed, comprising:

passing the crude oil feed having a mercury concentration through a filtration device having a filter element to retain at least 50% of the mercury on the filter element and generate a filtered crude having a reduced concentration of mercury;

back-flushing the filtration element with a portion of the filtered crude to generate a reject stream containing crude oil having a concentrated mercury level of at least 20 times the concentration of mercury in the crude oil feed;

mixing into the reject stream an effective amount of a reducing agent to convert a portion of the mercury into a volatile mercury;

removing a portion of the volatile mercury by one of stripping, scrubbing, adsorption, and combinations thereof to obtain a treated crude oil having a reduced concentration of mercury.

32. The method of claim 31, wherein the reducing agent is selected from sulfur compounds containing at least one sulfur atom having an oxidation state less than +6; ferrous compounds; stannous compounds; oxalates; cuprous compounds; organic acids which decompose to form $CO_2$ upon heating; hydroxylamine compounds; hydrazine compounds; sodium borohydride; diisobutylaluminium hydride; thiourea; transition metal halides; sulfites, bisulfites and metabisulfites; oxalic acid, cuprous chloride, stannous chloride, sodium borohydride, and mixtures thereof.

* * * * *